United States Patent [19]

Simo

[11] 4,380,340

[45] Apr. 19, 1983

[54] BLEEDER ATTACHMENT FOR ARROWS

[76] Inventor: Miroslav A. Simo, 370 N. Delaplaine Rd., Riverside, Ill. 60546

[21] Appl. No.: 301,027

[22] Filed: Sep. 10, 1981

[51] Int. Cl.[3] ..... F41B 5/02

[52] U.S. Cl. ..... 273/416; 273/418; 273/419

[58] Field of Search ..... 273/416, 418–422

[56] References Cited

U.S. PATENT DOCUMENTS

| | | | |
|---|---|---|---|
| 1,950,851 | 3/1934 | Konrad | 172/554 X |
| 2,467,838 | 4/1949 | Lust et al. | 273/418 |
| 2,888,264 | 5/1959 | Sharrar et al. | 273/420 |
| 3,565,435 | 2/1971 | Bear | 273/418 |
| 4,254,958 | 3/1981 | Bateman | 273/421 |
| 4,268,038 | 5/1981 | Wierenga | 273/416 |

*Primary Examiner*—Paul E. Shapiro
*Attorney, Agent, or Firm*—Thomas W. Speckman

[57] ABSTRACT

A bleeder attachment for arrows which fits over the arrow shaft directly behind the arrowhead. The bleeder attachment body may be bulbous or any other suitable shape, and includes a plurality of barbs which extend outwardly and are disposed toward its front end. A lip on the front end of the bleeder attachment body may be used to secure the bleeder attachment to the arrow by disposing the lip between the arrowhead and the arrow shaft. Grooves may be provided on the outer surface of the bleeder attachment body to promote fluid drainage. The bleeder attachment assures quick and sure killing of an animal hit by an arrow of this invention and is readily removable from the arrow.

9 Claims, 4 Drawing Figures

BLEEDER ATTACHMENT FOR ARROWS

BACKGROUND OF THE INVENTION

1. Field of the Invention

This invention relates to removable attachments for hunting arrows which increase bleeding upon entry of the arrow into an animal.

When an arrow punctures an animal's hide and enters its body, the portions of the hide which are torn open and pushed aside by the arrow head partially close around the arrow shaft after the arrow head passes through the hide. Thus, the hide wound is effectively the size of the arrow shaft and if the shaft remains in the wound in the hide, the shaft closure of the wound significantly reduces bleeding from the wound. If the arrow does not pierce a vital organ, the animal may suffer for a long period of time before it dies or may heal with the arrow shaft through its hide. Increasing the bleeding causes a faster, more sure, and humane death.

2. Description of the Prior Art

Prior attempts to increase bleeding have been made by modifying the blade design of the arrowhead, as shown in U.S. Pat. Nos. 2,820,637 and 3,419,273. However, such modified designs of arrowheads do not provide desired flight characteristics. Barbs may be secured to the arrow disposed away from the arrowhead, as shown in U.S. Pat. Nos. 2,939,708, 3,168,313, 2,289,284 and 1,133,189. Such barbs have a tearing effect only when the arrow is withdrawn, and do not open the wound as the arrow enters the animal. Thus, there is a need for removable attachments for hunting arrows which open and maintain a wound of a size greater than that of the arrow shaft and to enhance bleeding.

SUMMARY OF THE INVENTION

In accordance with one aspect of the invention, a bleeder attachment for arrows which have a detachable arrowhead is a detachable element which slips over the arrow shaft directly behind the arrowhead. The element may be generally bulbous and includes a plurality of barbs which extend outwardly and are disposed in a direction toward the arrowhead. A lip on the front of the element may be used to secure the bleeder attachment to the arrow. Cutouts may be provided for enhanced liquid drainage.

Accordingly, an object of this invention is to provide a bleeder attachment for arrows which opens upon entry though an animal's skin and maintains a wound of a size which is larger than the diameter of the arrow shaft.

Another object is to provide a bleeder attachment for arrows which is detachable.

Still another object is to provide a bleeder attachment for arrows which does not require modification of the arrows and which may be used with a wide variety of arrowheads.

BRIEF DESCRIPTION OF THE DRAWINGS

The above mentioned and other features and objects of this invention and the manner of obtaining them will become more apparent, and the invention itself will be best understood by reference to the following description of preferred embodiments of the invention taken in conjunction with the accompanying drawings in which.

DESCRIPTION OF PREFERRED EMBODIMENTS

Figure 1:
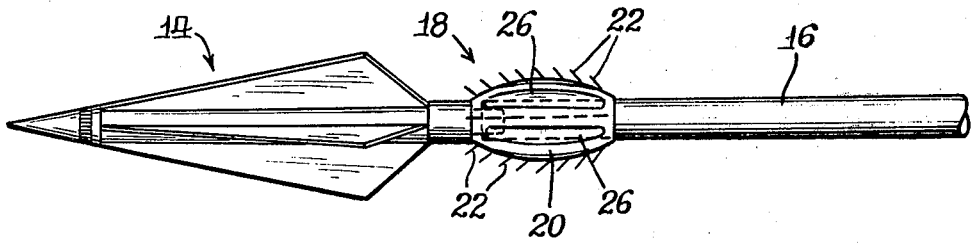
FIG. 1 is a side view of an arrow including a bleeder attachment of one embodiment of this invention.
Figure 3:
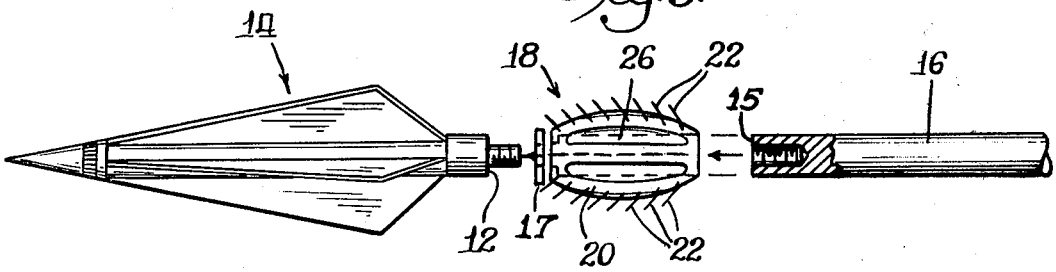
FIG. 3 is an exploded view of the arrow shaft, bleeder attachment and arrowhead as shown in FIG. 1.
Figure 2:
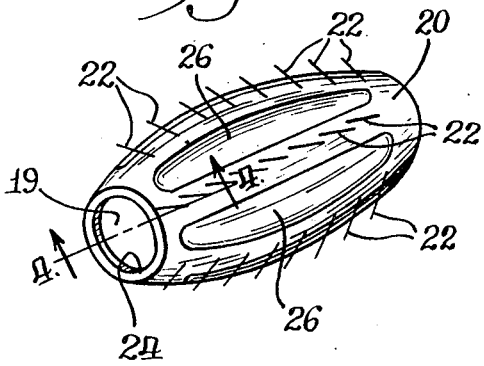
FIG. 2 is a perspective view of the bleeder attachment of FIG. 1.
Figure 4:
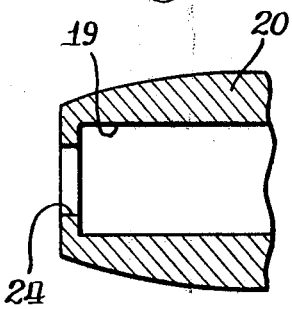
FIG. 4 is a partial section view along the line 4—4 shown in FIG. 2.

As shown in the figures, an arrow comprises arrowhead assembly 14 threadedly secured to the forward end of an arrow shaft 16. When head 14 is in place, without bleeder attachment 18, rear end 12 of head assembly 14 abuts front end 15 of shaft 16. Head 14 may have any suitable blade design and different heads may be used with bleeder attachment 18.

Bleeder attachment 18 is generally tubular shaped and has a through bore 19 which is slightly larger than the shaft 16. The bleeder attachment slips over the front end of shaft 16 when head 14 is removed and is held in place by a lip 24 which fits between front end 15 of shaft 16 and rear end 12 of head 14.

Bleeder attachment 18 includes body 20 and a plurality of barbs 22 secured to body 20. Barbs 22 extend outwardly disposed towards the front of body 20 and arrowhead 14 when bleeder attachment 18 is in place on shaft 16. Barbs 22 and body 20 may be made of any suitable material, such as plastic, metal, or the like. It is preferred that body 20 be plastic and barbs 22 metal.

Body 20 may be any suitable shape larger than the diameter of arrow shaft 16. A preferred shape is a bulbous form shown in the figures. Barbs 22 may be arranged on body 20 in any desired configuration, and may be arranged in rows along the length of the body or in rings around body 20. Grooves 26 may be provided in body 20 to provide for enhanced fluid drainage through the hide of a wounded animal.

Bleeder attachment 18 may be secured to the arrow by removing arrowhead 14 and slipping the attachment over shaft 16 until lip 24 abuts front end 15 of the shaft. Lip 24 may be omitted and a holding means, such as a ridge or pin extending from shaft 16 at the rear end of bleeder 18 may hold the bleeder in place. Arrowhead 14 may then be replaced on shaft 16, securing bleeding attachment 18 in place. If desired to balance the arrow, weighting washers 17 may be inserted between bleeder attachment 18 and arrowhead 14. The bleeder attachment may be easily removed by removing arrowhead 14, removing bleeder attachment 18, and following replacement of arrowhead 14 the arrow is ready for use without a bleeder attachment. The weight of the bleeder attachment may be compensated for by addition of weighting washers between rear end 12 of arrowhead 14 and front end 15 of arrow shaft 16.

When the arrow pierces the hide of an animal, the body 20 and barbs 22 of bleeder 18 open the wound to a larger size than the diameter of arrow shaft 16. The wound is opened by element 20 and frayed by the barbs 22 to promote bleeding. Grooves 26 along the long axis of the outer surface of bleeder attachment 18 provide open flow paths for blood to drain from the animal. The arrow with the bleeder attachment in place may easily be removed from the animal without damage to the bleeder attachment.

The advantages of this invention are self-apparent. The bleeder attachment opens the wound to a size greater than the arrow shaft promoting quick and sure death to the animal. The arrow need not be modified in any way for use with the bleeder attachment which is readily detachable.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A bleeder attachment for fitting over the shaft portion of an arrow having a detachable arrowhead portion, said bleeder attachment comprising:

a body element of generally tubular shape having a bulbous outer surface, a forward and a rearward end and having a cylindrical through opening centered about its long axis, the forward end of said cylindrical through opening having an inwardly extending lip; and a plurality of barbs secured to said outer surface extending outwardly and disposed toward said forward end.

2. The bleeder attachment of claim 1 wherein said body has a plurality of grooves extending longitudinally along its outer surface to promote fluid drainage.

3. An arrow comprising:

an arrow shaft;

a detachable arrowhead secured to said shaft;

a bleeder attachment secured over the front end of said arrow shaft, said bleeder attachment comprising a body element of generally tubular shape having a forward and a rear end and having an outer surface greater in diameter than said shaft; and a plurality of barbs secured to said outer surface extending outwardly disposed toward said forward end.

4. The arrow of claim 3 wherein said body is bulbous.

5. The bleeder attachment of claim 4 wherein said body has a lip extending inwardly at said forward end, the diameter of the opening provided by said lip being smaller than the diameter of said arrow shaft for securement of said bleeder attachment to said shaft.

6. The arrow of claim 4 wherein said body has a plurality of grooves extending longitudinally along its outer surface to promote fluid drainage.

7. The arrow of claim 3 wherein said body has a lip extending inwardly at said forward end, the diameter of the opening provided by said lip being smaller than the diameter of said arrow shaft for securement of said bleeder attachment to said shaft.

8. The arrow of claim 7 wherein said body has a plurality of grooves extending longitudinally along its outer surface to promote fluid drainage.

9. The arrow of claim 3 wherein said body has a plurality of grooves extending longitudinally along its outer surface to promote fluid drainage.

* * * * *